US007380378B2

(12) United States Patent
Clifford et al.

(10) Patent No.: US 7,380,378 B2
(45) Date of Patent: Jun. 3, 2008

(54) GLASS DOOR OR PARTITION SUPPORT RAIL

(75) Inventors: Brian W. Clifford, Saint John, IN (US); James R. Stremplewski, Frankfort, IL (US); Matthew R. JaBaay, Dyer, IN (US)

(73) Assignee: Doralco, Inc., Alsip, IL (US)

( * ) Notice: Subject to any disclaimer, the term of this patent is extended or adjusted under 35 U.S.C. 154(b) by 81 days.

(21) Appl. No.: 11/405,942

(22) Filed: Apr. 18, 2006

(65) Prior Publication Data

US 2007/0240371 A1 Oct. 18, 2007

(51) Int. Cl.
*E06B 1/30* (2006.01)

(52) U.S. Cl. ..... 52/204.72; 52/127.8; 52/800.16

(58) Field of Classification Search ..... 52/204.72, 52/204.71, 800.15, 800.16, 800.17, 800.13, 52/800.14, 127.8; 49/380, 413; 198/836.2, 198/836.3, 937; 4/557, 607; 160/199, 213
See application file for complete search history.

(56) References Cited

U.S. PATENT DOCUMENTS

| | | | | |
|---|---|---|---|---|
| 3,789,564 A | | 2/1974 | Kessler | |
| 4,235,049 A | | 11/1980 | Marinoni et al. | |
| 4,655,025 A | | 4/1987 | Marinoni | |
| 4,680,903 A | | 7/1987 | Horgan, Jr. | |
| 4,689,853 A | * | 9/1987 | Marinoni | 16/382 |
| 4,920,717 A | * | 5/1990 | Hooper, Jr. | 52/204.597 |
| 4,977,642 A | * | 12/1990 | Marinoni | 16/257 |
| 5,069,010 A | * | 12/1991 | Trainor et al. | 52/127.8 |
| 5,203,115 A | * | 4/1993 | Marinoni | 49/388 |
| 5,444,958 A | * | 8/1995 | Lu | 52/775 |
| 6,925,685 B2 | * | 8/2005 | Chen | 16/332 |
| 2005/0050685 A1 | * | 3/2005 | Chen | 16/332 |

* cited by examiner

*Primary Examiner*—Robert Canfield
*Assistant Examiner*—Jessie Fonseca
(74) *Attorney, Agent, or Firm*—Greer, Burns & Crain, Ltd.

(57) ABSTRACT

An edge rail for a pane or panel of glass or like material to be used as a door or partition is made of mating male and female rail sections defining a channel for reception of and secure attachment to an edge portion of a pane or panel. The two rail sections have portions thereof cut away and defining a recess or chamber for reception of a door or partition supporting structure directly within the rail and not as an appendage thereto. The edge rail has substantially universal application as either a top rail or a bottom rail and for either a right hand mount or a left hand mount. The rail is relatively small, slim and compact and imparts an esthetically pleasing appearance to the panel assembly.

19 Claims, 3 Drawing Sheets

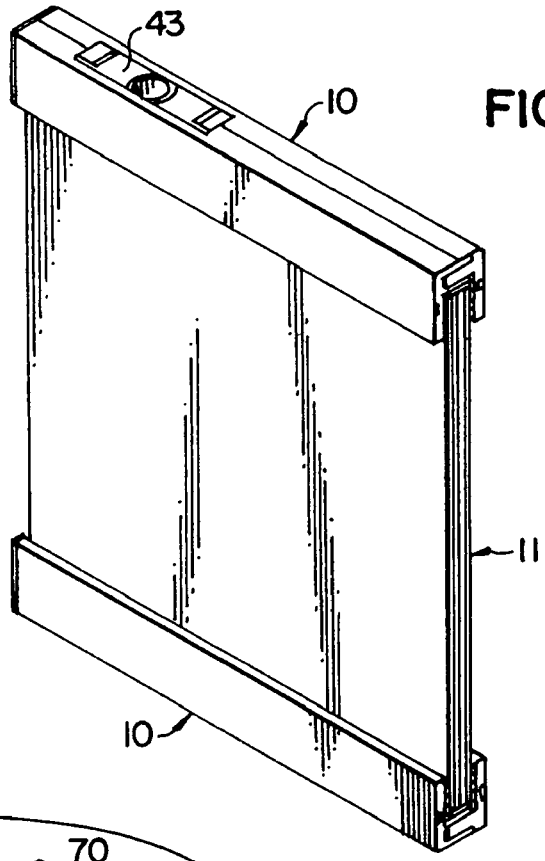
FIG. 1
FIG. 5
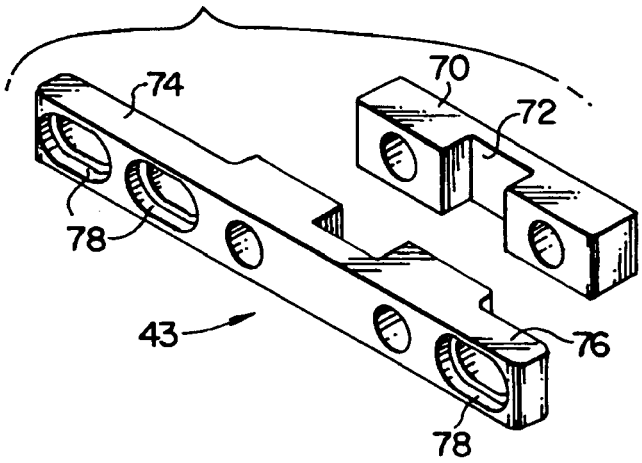
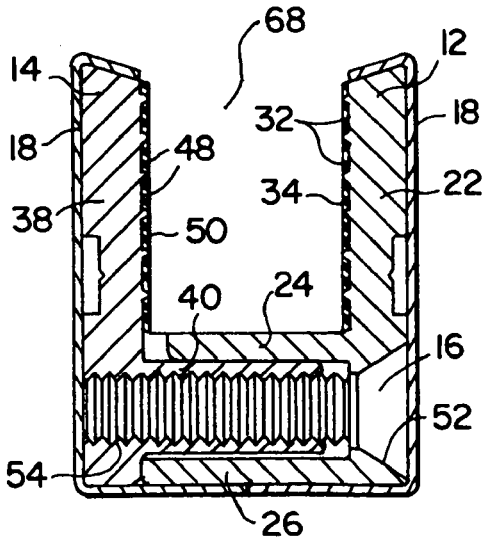
FIG. 4

GLASS DOOR OR PARTITION SUPPORT RAIL

FIELD OF THE INVENTION

The present invention relates to mounting and support rails for panes or panels of glass or similar materials to be used as doors or partitions.

BACKGROUND OF THE INVENTION

Glass panels are widely used as doors and partitions in a variety of commercial and business settings. A popular way of mounting glass panels as doors or partitions employs support rails or similar frame elements which attach to only the top and bottom edges of the glass panel. This eliminates the need for vertical side frame elements and permits an unobstructed view through a series of contiguous glass panels. Individuals support rails are assembled onto the top and bottom edges of the glass panels and allow the panels to be mounted to either the floor or ceiling if the panel is to be used as a partition or wall, or to a door frame if the glass panel is to be used as a door.

U.S. Pat. Nos. 4,235,049 and 4,655,025 to Marinoni; U.S. Pat. No. 4,680,903 to Horgan Jr.; and U.S. Pat. No. 5,069,010 to Trainor Jr. et al. disclose edge rails for glass panels. U.S. Pat. No. 5,069,010 is owned by the Assignee of the present invention and is incorporated herein by reference.

Generally, these prior edge rails are relatively large and complex combinations of multiple components. Many are capable of use solely for a specific installation. In most, a downwardly or upwardly open channel is required respectively for the bottom and top rails to house accessory components such as door hinges, door closers and door locks.

It is desirable therefore to provide a support rail which is versatile enough to be used in a wide variety of installations and that is simple and quick to assemble on a panel.

It is the object of the present invention to provide an improved support rail for glass panels that is versatile and simple to use and that, in particular, is small, compact and streamlined and presents an esthetically desirable appearance.

SUMMARY OF THE INVENTION

In accordance with the invention, a support rail for glass panels is comprised simply of a pair of rail sections between which the edge of the pane or panel is received and secured and which accommodate housing therein of the panel mounting and/or pivot structure.

The rail is universal in use. It maybe employed as either a top rail or a bottom rail and for either a right hand mounting or a left hand mounting. The rail sections receive therein the requisite mounting and/or pivot structures and eliminate the prior requirement for a separate accessory channel for reception and housing of such structures.

The rail is of simple, compact and streamline construction and affords an esthetically desirable appearance. It also provides for dry glazing of glass panes and panels and is economical in construction and use.

These and other objects and advantages of the invention will become apparent to those of reasonable skill in the art from the following detailed description, as considered in conjunction with the accompanying drawings.

BRIEF DESCRIPTION OF THE DRAWINGS

FIG. 1 is a perspective view of a panel of glass or the like provided with edge rails in accordance with the invention;

FIG. 2 is an exploded perspective view of the edge rail of the invention positioned for use as a top rail for the top edge of a panel of glass or the like;

FIG. 3 is an exploded perspective view of the edge rail of the invention positioned for use as the bottom rail for the bottom edge of a panel of glass of the like;

FIG. 4 is a vertical cross section of the glass engaging and supporting rail sections of the rail of the invention; and FIG. 5 is an isometric view of an alternate door mounting structure for use with the rail of the invention.

DETAILED DESCRIPTION OF A PREFERRED EMBODIMENT

The following is a detailed description of an embodiment of the invention presently contemplated by the inventors to be the best mode of carrying out their invention.

Referring to FIG. 1, elongated edge support rails 10 are shown connected to the bottom and top edges of a pane or panel 11 of glass or similar material. Support rails 10 extend substantially the entire width of panel 11 and are attached to the edges of panel 11 by clamping means to be described below. The support rails 10 need not extend the entire width of panel 11. The rails 10 and panel 11 comprise an assembly adapted to be mounted in a suitable frame (not shown) to enable panel 11 to act as either a door or a partition.

Figure 2:
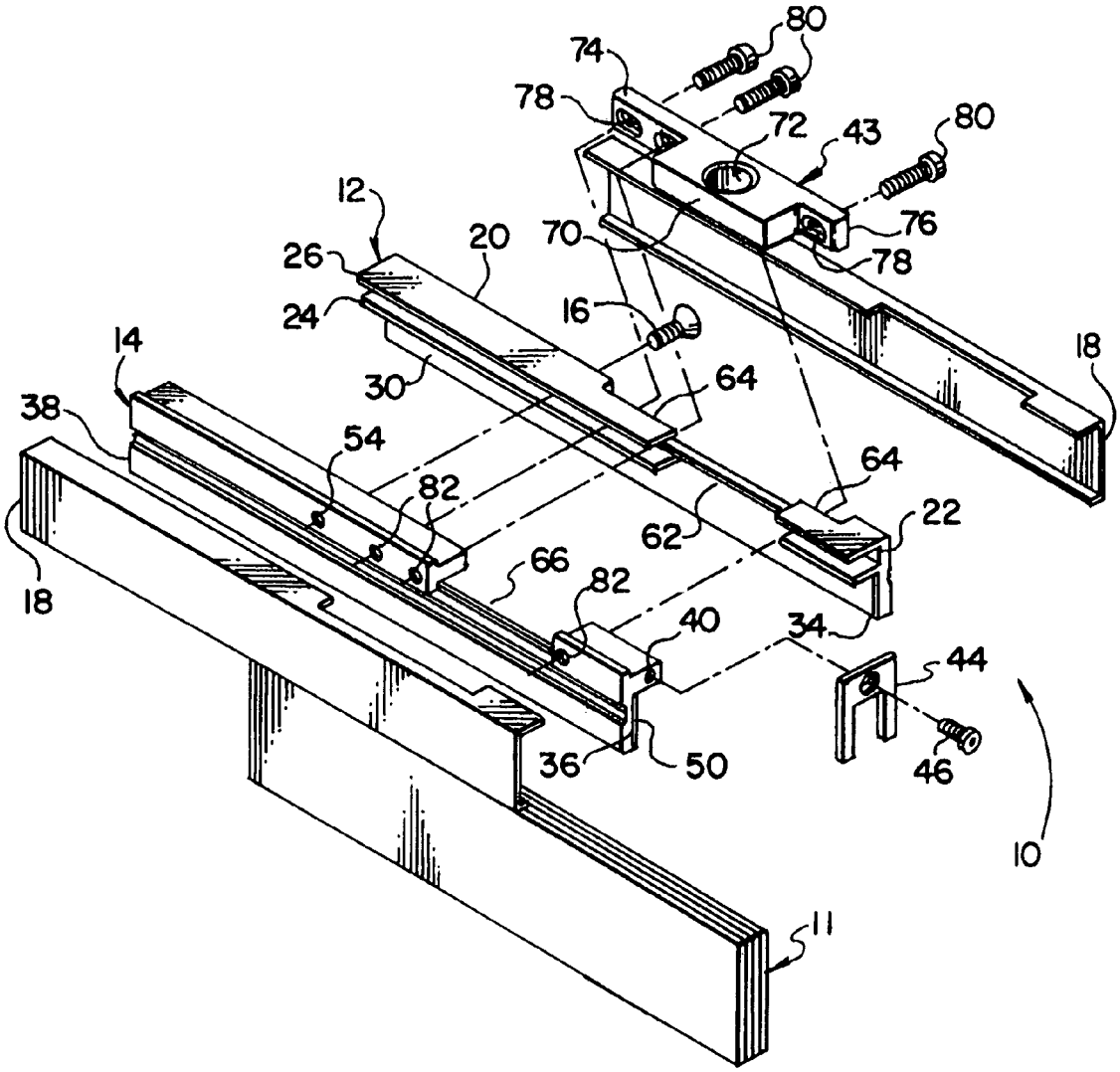
Figure 3:
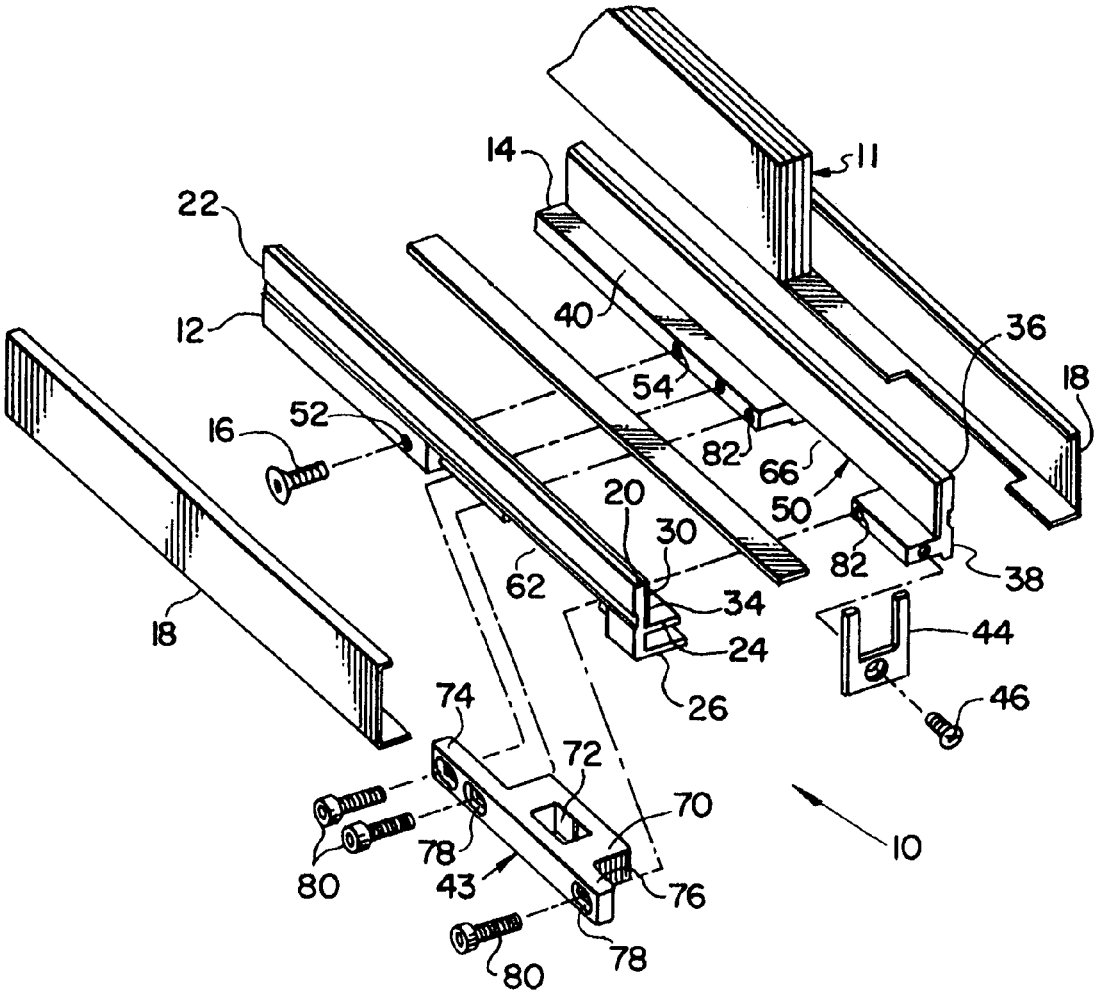

Referring to FIGS. 2, 3 and 4, the support rail 10 is comprised of a longitudinally extending female rail section 12, a longitudinally extending male rail section 14, a plurality of screws or adjustable fastening or clamping means 16 extending transverse to rail sections 12 and 14, and a pair of longitudinally extending side cladding members or rail cover members 18.

Female rail section 12 has a mounting section 20, a vertically extending sidewall 22, a first horizontal female flange 24 extending transversely from sidewall 22 and spaced a distance from mounting section 20, and a second horizontal female flange 26 extending transversely from sidewall 22 a distance spaced from flange 24. The inner facing surface 30 of sidewall 22 is preferably formed or provided with a number of longitudinally extending parallel ridges or ribs 32, which provide a frictional mounting surface for a sealing strip or gasket 34 extending over the inner facing surface of portion 30 of sidewall 22. Gasket 34 is made of a resilient, flexible, electrometric material, such as rubber or a suitable plastic.

Male rail section 14 comprises a mounting section 36, a vertically extending sidewall 38 and a central male flange 40 extending transversely inwardly from sidewall 38 a distance from mounting section 36, which corresponds to the vertical distance from mounting section 20 to the portion of sidewall 22 between flange 24 and flange 26 of female rail section 12. Rail section 14 is also provided with a number of ribs or ridges 48 on an inner facing surface of sidewall 38 which provides a frictional mounting surface for a sealing strip or gasket 50 identical to gasket 34 on female rail section 12.

Rail sections 12 and 14 have generally uniformly thin cross sections. This allows these members to be manufactured by extrusion, thus eliminating the need to machine separate lengths of sections 12 and 14 individually, which would be costly and time consuming. In addition, because of the sturdiness inherent in their rectangle profiles, rail sections 12 and 14 can be made of relatively lightweight metal, such as aluminum. The use of a lightweight metal for rail sections 12 and 14 reduces the weight of support rail 10 and the door or partition assembly.

Female rail section 12 and male rail section 14 are connected by way of their flanges. Central flange 40 of male rail section 14 is positioned between flange 24 and flange 26 of female rail section 12. The rail sections are drawn and held together by a number of screws 16, or other appropriate adjustable securing means, spaced substantially uniformly along the length of support rail 10 at appropriate intervals. For example, a thirty-six inch support rail 10 may employ six screws 16 spaced at approximately six inch intervals, beginning approximately two to three inches from one end of support rail 10. Female rail section 12 is provided with a number of holes 52 corresponding to the number of screws 16. Holes 52 extend transversely through the portion of the sidewall 22 between upper flange 22 and lower flange 26 of female rail section 12. A number of corresponding holes 54 extend transversely into the central portion of the central flange 40 of male section 14. Holes 54 are threaded to receive screw 16, which extend through holes 52 and into holes 54 to thereby fasten rail section 12 to rail section 14 and to draw the side walls of the sections into secure engagement with a panel of glass or the like. Holes 52 are countersunk to conform to the heads of screws 16 so that the end faces of the screws are flush with the surface of the rail section 12 when assembled. Female rail section 12 preferably includes an opening or adjustment access port adjacent each hole 52 to allow access to screws 16 when cladding 18 is attached to the outer surface of rail section 12.

As illustrated in FIG. 4, cladding 18 simply clips or snaps onto the rail sections 12 and 14 and imparts a smooth, finished and attractive appearance to the rail.

Each end of support rail 10 may also be provided with an attractive end cap 44. End cap 44 is slotted or relieved along its edge to allow the glass panel 11 to protrude beyond the ends of support rail 10, if that is desired. The slotted portion of the end cap also allows for visual confirmation that support rail 10 is properly assembled with glass panel 11. End cap 44 is attached to support rail 10 by any convenient means, such as a screw 46 which fits through a countersunk hole in end cap 44 and into a corresponding threaded hole that extends longitudinally into central flange 40 of male rail section 14.

Female rail section 12 and male rail section 14 define a mounting channel 68. Sidewall 38 of male section 14 and portion 30 of sidewall 22 define the sidewalls, and the adjacent flange 24 defines the bottom wall, of the channel 68. Panel 11 is assembled with the support rail 10 by placing panel 11 into channel 68 between the gaskets 34 and 50. Screws 16 are advanced to pull or draw male rail section 14 into female rail section 12, thereby bringing sidewalls 22 and 38 and their corresponding gaskets 34 and 50 into secure engagement with panel 11.

The specific construction, mode of operation and functions of the flanges 24, 26 and 40 and the sealing strips or gaskets 34 and 50 may be and preferably are substantially the same as described in U.S. Pat. No. 5,069,010.

In accordance with the invention, the flanges 24 and 26 of the female rail 12 are cut away or relieved adjacent one end of the rail, as illustrated at 62, to define a chamber pocket, and the wall 22 of the rail 12 is notched or relieved at opposite sides of the pocket 62, as indicated at 64. An aligned and complementary pocket chamber portion 66 is formed in the male rail section 14 by relieving or cutting away portions of the flange 40 and adjoining wall 38. When the two rail sections are assembled, the pockets 62 and 66 and notches 64 define a recess or chamber within the two rail sections for reception of a panel mounting and/or pivot structure 43. The structure 43 is formed of a strong and wear resistant material, such as steel, and may comprise a bottom pivot or door closure receiving member as illustrated in FIG. 3, or a top or overhead pivot receiving member as illustrated in FIG. 2, or a two-piece top or overhead concealed door closure receiving member as illustrated in FIG. 5. In the illustrated embodiments, the structure 43 is of generally T-shape with a central portion 70 having an aperture or opening 72 for receiving a door pivot or operator and a pair of legs 74 and 76 extending in opposite directions from the central portion 70. Each leg has one or more holes 78 therein accommodating passage of bolts 80 or other fastening means which extend to and are secured within threaded holes 82 in the flange 40 of the male rail section 14. The mounting is preferably such that the surface of the structure 43 is substantially flush with the outer surface of the rail 10, as illustrated in FIG. 1.

In the several embodiments illustrated, and as is shown particularly in FIG. 5, the mounting structure 43 is adjustably mounted on the rail 10 to facilitate adjustment of the mounting structure 43 relative to the panel 11, and in turn to facilitate alignment of the panel within its frame. Specifically, the legs 74 and 76 of the mounting structure 43 have relatively large and horizontally extending elliptical holes 78 therein so that the structure 43 is adjustably positionable about the bolts 80 within the rail sections 12 and 14. The extended or slot like holes 78 thus accommodate adjustment of the mounting structure by approximately ¼ inch, which in turn provides for adjustable mounting of the panel 11 within its frame to insure proper alignment of the panel within the frame. The bolts 80 then secure the panel in aligned and adjusted position.

The panel mounting and/or pivot members 43 are thus adjustably mounted on and enclosed within the rail 10 and do not constitute separate appendages that need to be housed and concealed within a supplementary accessory channel as in the past.

The invention provides a very small, slim and streamline edge rail for glass and similar panes and panels, that impart thereto an esthetically desirable appearance. Additionally, the rail is substantially universally adaptable for use either as a top rail or a bottom rail and for use as either a right hand mounting or a left hand mounting.

The objects and advantages of the invention have thus been shown to be attained in a convenient, economical, practical and facile manner.

While preferred embodiments of the invention have been herein illustrated and described, it is to be appreciated that various changes, rearrangement and modification may be made therein without departing from the scope of the invention as defined by the appended claims.

What is claimed is:

1. An edge rail for a panel, comprising:

a female rail section having a pair of spaced flanges, a male rail section having a flange extending into a space between the spaced flanges on the female rail section, and fastening means extending between said sections for drawing the sections together, said sections defining therebetween a channel for reception of edge portions of the panel and said fastening means drawing said sections together into secure engagement with one another and the edge portions of the panel, said sections having relieved portions defining a chamber within the rail for reception of a panel mounting structure, said relieved portions of said rail sections comprising a portion of the flange on the male rail section for reception of a central portion of the mounting structure and aligned portions of the flanges on the female sections for reception of the central portion and a pair of legs of the mounting structure.

2. An edge rail as set forth in claim 1, including a panel mounting structure housed within said chamber.

3. An edge rail as set forth in claim 1, said rail sections including side walls extending transversely from said flanges, said side walls and the adjacent one of the flanges on said female rail section defining the channel for reception of the edge portions of the panel.

4. An edge rail as set forth in claim 3, said fastening means comprising a plurality of threaded fasteners spaced substantially uniformly along said rail sections and extending through aligned holes in one rail section and into threaded holes in the other rail section.

5. An edge rail as set forth in claim 4, each said fastener having a head and each said hole in said one rail section having a complementary countersink receiving the head of the respective fastener with the head of the fastener substantially flush with the surface of said one rail section.

6. An edge rail as set forth in claim 3, including a resilient gasket on each of said side walls for conformable engagement with the edge portions of the panel.

7. An edge rail as set forth in claim 3, said relieved portions of said rail sections comprising aligned and complementary portions of said flanges, said side walls remaining substantially intact for uniform length-wise engagement with the edge portions of the panel.

8. An edge rail as set forth in claim 2, said panel mounting structure having holes therethrough and including structure fastening means extending through said holes for securing said mounting structure to said rail sections, said holes being larger than the fastening means passing therethrough for accommodating adjustment of the panel mounting structure relative to the panel.

9. An edge rail as set forth in claim 2, said central portion of the mounting structure for mounting the panel and said pair of legs extending laterally in opposite directions from the central portion, said legs having holes therethrough, mounting structure fastening means extending through said holes for securing the mounting structure to said rail sections, the flange on the male rail section having holes therein aligned with the holes in the legs of the mounting structure for reception of the mounting structure fastening means.

10. An edge rail as set forth in claim 9, said mounting structure fastening means securing the mounting structure to said male rail section and said rail section fastening means securing said female rail section to said male rail section, said mounting structure being housed within the chamber defined by the relieved portions of said rail sections.

11. An edge rail as set forth in claim 9, the holes in the legs of the mounting structure being larger than the fastening means passing therethrough and accommodating adjustment of the panel mounting structure relative to the panel.

12. An edge rail as set forth in claim 11, said holes in the legs of the mounting structure being countersunk for receiving the mounting structure fastening means within and/or flush with the surface of the mounting structure.

13. An edge rail as set forth in claim 1 for mounting panels of glass to be used as doors or partitions, said rail sections being applicable to either a top edge or a bottom edge of the panel and comprising either a top rail or a bottom rail for the panel.

14. An edge rail as set forth in claim 13 including a panel mounting structure housed within said recess or chamber, said panel mounting structure comprising one of a bottom closure receiving member, or a top pivot receiving member.

15. An edge rail for mounting panels to be used as doors or partitions comprising:

a female rail section having a pair of spaced flanges, a male rail section having a flange extending into a space between the spaced flanges on the female rail section, fastening means for drawing the sections together, said rail sections defining therebetween a channel for reception of edge portions of a panel, portions of said flanges being relieved and defining a chamber within the flange portion of said rails for reception of a panel mounting structure.

16. An edge rail as set forth in claim 15, wherein said panel mounting structure is adjustably fastened to the flange of at least one of said rail sections.

17. An edge rail as in claim 15, said mounting structure comprising a central portion and a pair of legs extending in opposite directions from said central portion, said legs having holes therein for passage of fastening means into the flange of said male section, the holes in the legs of the panel mounting structure being larger than the fastening means passing therethrough for accommodating adjustment of the mounting structure relative to the panel.

18. An edge rail for a panel to be used as a door or a partition comprising:

a female rail section having a pair of spaced flanges and a side wall extending transversely from said flanges, a male rail section having a flange extending into a space between the spaced flanges on the female rail section and a side wall extending transversely from said flange opposite the side wall on said female rail section, first fastening means extending between said rail sections for drawing said sections together, said side walls defining a channel for reception therebetween of edge portions of a panel, a panel mounting structure housed within said rail sections, said structure comprising a central portion and a pair of legs extending in opposite directions from said central portion, said legs having holes therein for passage of fastening means, and second fastening means extending through the holes in the legs of the mounting structure for securing the mounting structure to at least one of said rail sections, a portion of the flange on said male rail section being relieved for reception of the central portion of the panel mounting structure, said male rail section having holes therein to opposite sides of said relieved portion for reception of said second fastening means, a portion of the flanges on said female rail section being relieved for reception of the central portion and the legs of the mounting structure;

the relieved portions of said rail sections defining a chamber receiving therein the panel mounting structure, said second fastening means extending through the holes in the legs of the mounting structure and into the holes in said male rail section for securing the panel mounting structure to said male rail section, said first fastening means securing said female rail section to said male rail section with the panel mounting structure housed within said rail sections.

19. An edge rail as set forth in claim 16, the holes in the legs of the panel mounting structure being larger than the fastening means passing therethrough and accommodating adjustment of the mounting structure relative to the panel.

* * * * *